US007825800B2

(12) United States Patent
Cox

(10) Patent No.: US 7,825,800 B2
(45) Date of Patent: Nov. 2, 2010

(54) SECURITY SYSTEM

(76) Inventor: Jayne Cox, 112 Ovalwood Dr., Gray, TN (US) 37615

( * ) Notice: Subject to any disclaimer, the term of this patent is extended or adjusted under 35 U.S.C. 154(b) by 964 days.

(21) Appl. No.: 11/251,806

(22) Filed: Oct. 18, 2005

(65) Prior Publication Data

US 2007/0085679 A1 Apr. 19, 2007

(51) Int. Cl.
*G08B 13/00* (2006.01)

(52) U.S. Cl. ..... 340/541; 340/539.1; 340/568.1; 340/572.1; 340/10.1

(58) Field of Classification Search ..... 340/541, 340/539.1, 988, 531, 568.1, 571, 572.1, 540, 340/989, 991, 10.1, 10.4, 10.41
See application file for complete search history.

(56) References Cited

U.S. PATENT DOCUMENTS

| | | | | |
|---|---|---|---|---|
| 4,145,581 | A * | 3/1979 | Stockdale | 379/356.01 |
| 4,257,038 | A * | 3/1981 | Rounds et al. | 340/539.16 |
| 4,641,127 | A * | 2/1987 | Hogan et al. | 379/40 |
| 5,483,224 | A * | 1/1996 | Rankin et al. | 340/539.17 |
| 5,621,385 | A * | 4/1997 | Carney | 340/541 |
| 5,808,547 | A * | 9/1998 | Carney | 340/541 |
| 6,137,405 | A | 10/2000 | Carney | |
| 6,366,648 | B1 | 4/2002 | Carney | |
| 6,369,708 | B2 * | 4/2002 | Carney | 340/541 |
| 7,081,813 | B2 * | 7/2006 | Winick et al. | 340/521 |
| 7,088,265 | B2 * | 8/2006 | Tsui et al. | 340/988 |
| 7,205,908 | B2 * | 4/2007 | Tsui et al. | 340/988 |
| 2005/0134454 | A1 * | 6/2005 | Eskildsen | 340/539.14 |

* cited by examiner

*Primary Examiner*—Daniel Previl
(74) *Attorney, Agent, or Firm*—Dennis Clarke

(57) ABSTRACT

In a security system for monitoring security in a predetermined space from outside the space, the security system comprising:

(a) at least one detection means located in or near the space for determining a violation of security in the space, the detection means having a normal mode representative of no violation of security and an abnormal mode representative of a violation of security, (b) information storing means associated with the detection means for storing data indicative of either the normal or abnormal mode, (c) means associated with the information storing means adapted for receiving a first signal from a location outside the space and capable of transmitting a second signal to the source of the first signal the nature of the mode of the detection means stored in the storing means, and (d) a signal transmitting means for transmitting the first signal to the receiving means and for receiving therefrom the second signal indicative of the mode;

the improvement wherein the signal transmitting means is affixed to a vehicle and is adapted to transmit the signal continuously at a predetermined distance from the space and to receive the indication of mode at a second predetermined distance from the space.

18 Claims, 2 Drawing Sheets

SECURITY SYSTEM

FIELD OF THE INVENTION

The invention relates generally to intrusion surveillance systems and more particularly to a self-contained security detection system and method that monitors a predetermined space for an occurrence of an intrusion. The self-contained monitor may be remotely tested by a returning occupant to determine if an intrusion event has occurred in the predetermined space.

BACKGROUND OF THE INVENTION

The invention addresses the problem of home security, and the increasing concern for personal safety of those living in both urban and rural areas. An individual is especially susceptible to attack by an intruder from the time he or she leaves an automobile, or a group of friends, up to the time he or she enters the home and re-locks the door. Several factors add to the vulnerability of the resident. For example, the intruder generally cannot be seen by the resident or neighbors prior to attacking. The resident often has arms filled with grocery bags, a handbag, a brief case, or the like, prior to entering the home, and cannot easily escape or defend against the intruder. In addition, the intruder may hide in nearby trees or shrubbery, and wait until after the resident has unlocked the door before staging his attack and entering the home.

Security systems comprising a self-contained intrusion detector used to monitor a predetermined space having a remote controller transmitting an RF signal to control the self-contained monitor are well known in the prior art. In such systems, the monitor typically includes a primary power source, a motion sensor, a responder and a memory circuit. The motion sensor detects an unauthorized entry into the predetermined space causing the responder to, optionally sound an alarm and, at the same time, causing the memory circuit to record the occurrence of the intrusion. Before reentering the premises, a returning occupant activates the remote controller prompting a response from the self-contained monitor to determine if an intrusion event has occurred in order to determine whether it is safe to enter the premises.

Since the personal wellbeing of the returning occupant is at risk, it is essential that the self-contained monitor provides not only a reliable means by which to record an intrusion event but also a reliable means by which to remotely test whether an intrusion has, or has not, occurred. It is extremely dangerous for a returning occupant to unwittingly confront an intruder.

The systems of the prior art suffer from the disadvantage that the remote controllers associated therewith are hand-held and are often lost, misplaced or otherwise unavailable to the occupant of the premises when approaching the residence or secured space.

It is an object of the invention to provide an improved security system and method of the type described above wherein the remote controller is never unavailable to the occupant.

SUMMARY OF THE INVENTION

The above and other objects are realized by the present invention, one embodiment of which relates to an improved security system for monitoring security in a predetermined space from outside the space, the security system comprising:

(a) at least one detection means located in or near the space for determining a violation of security in the space, the detection means having a normal mode representative of no violation of security and an abnormal mode representative of a violation of security, (b) information storing means associated with the detection means for storing data indicative of either the normal or abnormal mode, (c) means associated with the information storing means adapted for receiving a first signal from a location outside the space and capable of transmitting a second signal to the source of the first signal the nature of the mode of the detection means stored in the storing means, and (d) a signal transmitting means for transmitting the first signal to the receiving means and for receiving therefrom the second signal indicative of the mode;

the improvement wherein the signal transmitting means is affixed to a vehicle and is adapted to transmit the signal continuously at a predetermined distance from the space and to receive the indication of mode at a second predetermined distance from the space.

Another embodiment of the invention concerns an improved method for monitoring security within a predetermined space from outside the space, the method comprising:

(a) providing at least one detection means located in or near the space for determining a violation of security in the space, the detection means having a normal mode representative of no violation of security and an abnormal mode representative of a violation of security, (b) providing information storing means associated with the detection means for storing data indicative of either the normal or abnormal mode, (c) providing receiving means associated with the information storing means adapted for receiving a first signal from a location outside the space and capable of transmitting a second signal to the source of the first signal the nature of the mode of the detection means stored in the storing means, and (d) providing a signal transmitting means for transmitting the first signal to the receiving means and for receiving therefrom the second signal indicative of the mode;

the improvement wherein the signal transmitting means is affixed to a vehicle and is adapted to transmit the signal continuously at a predetermined distance from the space and to receive the indication of mode at a second predetermined distance from the space.

Figure 1:
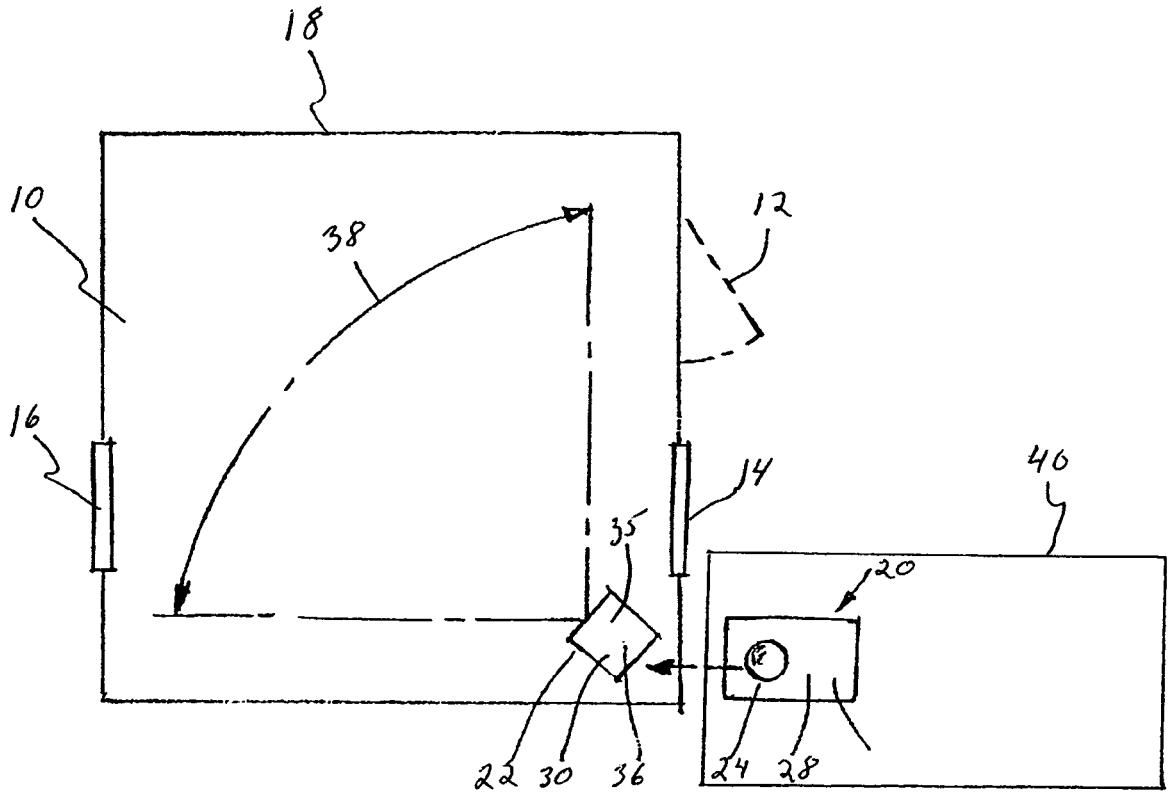
FIG. 1 is a plan view of a self-contained intrusion monitor according to the invention disposed to surveil a predetermined space. Also included in this figure is the remote controller.

Turning now to the Figures, there is shown in FIG. 1, by way of explanation, an intrusion detection system according to the invention for monitoring a predetermined space 10 for an intruder. The space 10 includes a door 12 and may or may not include additional openings such as a front window 14 and a rear window 16 depending on a particular premises 18 in which the system is deployed. The system comprises an authorized remote controller generally referred to by reference number 20 and, e.g., a Passive Infrared (PIR) intrusion monitor 22 (powered by connection to an AC outlet, battery pack or both, none shown) having a detection pattern 38. The remote controller 20 is installed in a vehicle 40 and includes a transmitter circuit 28 and remotely controls the intrusion monitor 22 by transmitting a Radio Frequency (RF) carrier signal to a receiver circuit 30 in monitor 22. The remote controller is powered by the power source for the vehicle or a battery pack (neither shown). Also in communication with the intrusion monitor 22 and receiver circuit 30 is a data storage element 36 and its own RF transmitter circuit 35. The intrusion monitor 22 is disposed within the predetermined space 10 and can be tested by the carrier signal initiated by an authorized user manipulating the button switch 24, if it is desired to manually activate the system, or automatically and continuously simply by the approach of the vehicle 40 to the premises 18. Arming and disarming of the monitor may be affected manually by means of a switch (not shown) located on the monitor, by means of switch 24 on the remote controller 20 or automatically by simply turning the ignition (or other vehicle activation mechanism) switch in the vehicle.

When armed, the intrusion monitor 22 normally registers a normal state or mode which is stored in data storage element 36. However, when an intruder enters space 10 the intrusion monitor registers an abnormal state or mode which is also stored in data storage element 36. Optionally, an alarm response (not shown) may be activated if the detection pattern 38 is entered by the intruder. In addition, the intrusion monitor 22 records and may be tested from outside of the premises 18 by the remote controller 20 for the intrusion so that a returning occupant is warned not to reenter the predetermined space 10, thus avoiding the risk of confronting the intruder.

The transmitter circuit 28 and the receiver circuit 30 noted in FIG. 1 operate in the following manner: If no intruder has entered the space 30 in the absence of the occupant thereof, the monitor 22 would remain in normal mode, which mode would be stored in data storage element 36.

Should an intruder violate the space 10, the detection monitor 22 registers an abnormal mode which is relayed to the data storage element 36 and replaces or overrides the normal mode.

Figure 2:
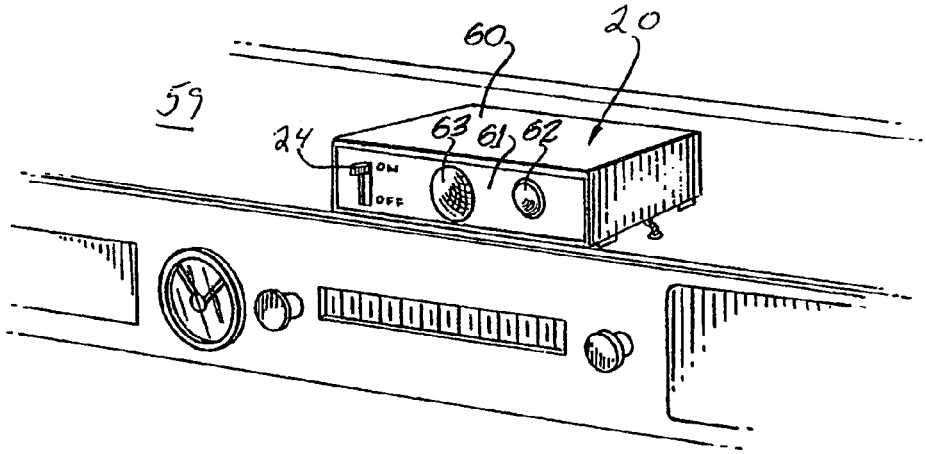
FIG. 2 is a perspective view of a vehicle dashboard having a portion of the security system of the invention mounted thereon

There is shown in FIG. 2 an embodiment of the invention where the remote controller 20 is depicted as a self-contained housing 60 mounted on instrumental panel 59 having a front surface 61 in which there is mounted an electric lamp 62 and/or electrically operated buzzer 63 along with manual switch 24. Upon receiving a signal from the receiving unit of the monitor 22 indicating an abnormal mode, one or both of the lamp or buzzer is activated to alert the driver of a violation of the security of space 38.

Figure 3:
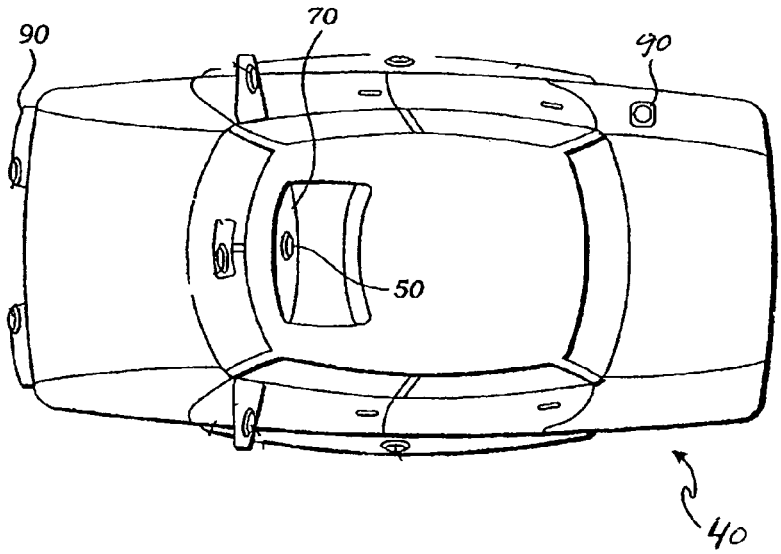
FIG. 3 is a mechanical schematic layout of a preferred embodiment of the invention.

There is shown in FIG. 3 an embodiment of the invention wherein the remote controller is not a self contained unit as shown in FIGS. 1 and 2, but rather comprises an RF transmitter 90 which may be mounted toward the front or rear or both of the vehicle 40. Upon receiving a signal from the receiving unit of the monitor 22 indicating an abnormal mode, the transmitter relays the signal to a visual or sound display 50, located on the instrument panel 70.

As will be apparent to those skilled in the art, the security system and method of the invention constitutes a vast improvement over the systems of the prior art which require the utilization of a hand-held remote controller which is very susceptible to theft, being misplaced or lost. The remote controller of the system of the invention, inasmuch as it constitutes an integral part of the vehicle, is not subject to these disadvantages. Moreover, the hand-held remote controllers of the prior art systems must be manually activated by the user in order to detect any signal from the secured area. Such a system would be vulnerable to the user simply forgetting to manually activate the remote controller whereas the system of the invention may be operated in a mode where the remote controller remains constantly armed while the vehicle is being operated or the vehicle activator switch (ignition, e.g.,) is activated.

Indeed, the system of the invention may also be used by those approaching the secured space on foot or in another vehicle. All that is required is that the person, whether on foot or in another vehicle, have access to the vehicle containing the remote controller, which is presumably near the secured space and activate the controller to determine the mode of the monitor inside the premises.

It will be recognized by those skilled in the art that the signals transmitted between the monitor and the remote controller need not be RF signals. The system may also be based on an exchange of laser, sonic or other type of signal.

It should also be apparent to those skilled in the art that no invention resides in the elements of the security system of the invention, i.e., the monitor or remote controller, but rather in the unique combination thereof in the system of the invention as described in the appended claims. Thus, any standard intrusion monitor which includes a conventional signal receiver and transmitter element and data storage unit may be employed in the practice of the invention. Similarly, any conventional self-contained remote controller capable of transmitting a signal to the monitor and receiving a response signal therefrom may be used in the practice of the invention. However, the non-self contained remote controller described in FIG. 3 does form part of the present invention as it is not disclosed nor suggested in the prior art.

The system of the invention may also be employed to simultaneously surveil multiple secured spaces in close proximity to each other, e.g., the units of an apartment building. A vehicle having a remote controller installed therein, such as a police car, e.g., could monitor any or all of the units in the building with the single remote controller installed therein, provided that the latter was address-specific to each unit and could distinguish therebetween upon receiving one or more signals indicating abnormal mode(s).

The system of the invention may also incorporate an interface module associated with either of the signal transmitting means that communicates with a telephone line and is adapted to automatically phone a predetermined number when an indication of abnormal mode is received and to generate a message to the receiver of the phone call that the detection means is in an abnormal mode.

The invention claimed is:

1. In a security system for monitoring security in a predetermined space from outside said space, said security system comprising:

(a) at least one detection means located in or near said space for determining a violation of security in said space, said detection means having a normal mode representative of no violation of security and an abnormal mode representative of a violation of security, (b) information storing means associated with said detection means for storing data indicative of either said normal or abnormal mode, (c) means associated with said information storing means adapted for receiving a first signal from a location outside said space and capable of transmitting a second signal to the source of said first signal the nature of the mode of said detection means stored in said storing means, and (d) means for transmitting said first signal to said receiving means and for receiving therefrom said second signal indicative of said mode; the improvement wherein said means (d) is affixed to a vehicle and is adapted to transmit said first signal continuously at a predetermined distance from said space and to receive said second signal indicative of said mode at a second predetermined distance from said space.

2. The system of claim 1 wherein said predetermined space includes a dwelling.

3. The system of claim 2 wherein said predetermined space also includes a predetermined area surrounding said dwelling.

4. The system of claim 1 wherein said system is address-specific.

5. The system of claim 1 wherein means (d) is powered by the power source for said vehicle.

6. The system of claim 1 wherein said vehicle is an automobile.

7. The system of claim 6 wherein said signal transmitter means continuously transmits said signal while said vehicle is operating.

8. The system of claim 1 wherein said indication of mode is displayed on the dashboard of said vehicle.

9. The system of claim 1 including an interface module associated with said means (d) that communicates with a telephone line and is adapted to automatically phone a predetermined number when an indication of abnormal mode is received.

10. The system of claim 9 wherein said interface module is also adapted to generate a message to the receiver of said phone call that said detection means is an abnormal mode.

11. The system of claim 1 wherein said means (d) is adapted to send said signal only at a predetermined distance from said space.

12. The system of claim 11 wherein said means (d) is equipped with signal activator means which prompts said signal transmitter means to transmit said signal only upon manual activation.

13. The system of claim 1 wherein said detection means comprises a plurality of security sensors spaced-apart within said space.

14. The system of claim 1 wherein said signal is a RF signal.

15. The system of claim 1 wherein said predetermined space itself includes multiple predetermined sub-spaces, one or more of said subspaces including an address specific system and said means (d) is adapted to separately receive said indication of mode in each of said subspaces in which said system is located.

16. The system of claim 1 including emergency alarm activation means associated with said vehicle adapted to transmit a signal to and activate at least one alarm located in the vicinity of said predetermined space.

17. The system of claim 16 wherein said alarm activation means is in communication with said means (d) and activates said alarm upon receiving an indication of abnormal mode.

18. In an improved method for monitoring security within a predetermined space from outside said space, said method comprising:

(a) providing at least one detection means located in or near said space for determining a violation of security in said space, said detection means having a normal mode representative of no violation of security and an abnormal mode representative of a violation of security, (b) providing information storing means associated with said detection means for storing data indicative of either said normal or abnormal mode, (c) providing receiving means associated with said information storing means adapted for receiving a first signal from a location outside said space and capable of transmitting a second signal to the source of said first signal the nature of the mode of said detection means stored in said storing means, and (d) providing means for transmitting said first signal to said receiving means and for receiving therefrom said second signal indicative of said mode; the improvement wherein said means (d) is affixed to a vehicle and is adapted to transmit said signal continuously at a predetermined distance from said space and to receive said indication of mode at a second predetermined distance from said space.

* * * * *